United States Patent [19]

Moomaw

[11] 4,159,087

[45] Jun. 26, 1979

[54] GLIDER KITE

[75] Inventor: David E. Moomaw, Clarence, N.Y.

[73] Assignee: The Quaker Oats Company, Chicago, Ill.

[21] Appl. No.: 847,220

[22] Filed: Oct. 31, 1977

[51] Int. Cl.[2] ..... B64C 31/06

[52] U.S. Cl. ..... 244/153 R; 46/79; 242/107; 244/154

[58] Field of Search ..... 244/153 R, 154, 155 R, 244/155 A, 16, DIG. 1; 46/77, 79; 242/107, 107.2, 107.3, 84.3, 96

[56] References Cited

U.S. PATENT DOCUMENTS

| | | | |
|---|---|---|---|
| 886,159 | 4/1908 | Sellers | 244/154 |
| 1,261,731 | 4/1918 | Fronsbahl | 244/154 |
| 1,267,135 | 5/1918 | Sprague, Jr. | 244/154 |
| 1,849,133 | 3/1932 | Baker | 244/154 |
| 1,927,835 | 9/1933 | Kellogg | 244/154 |
| 2,673,694 | 3/1954 | Howell | 242/107.3 |
| 2,869,801 | 1/1959 | Foster | 242/107.3 |
| 3,140,842 | 7/1964 | Craigo et al. | 244/DIG. 1 |
| 3,153,877 | 10/1964 | Effinger, Jr. et al. | 244/154 |
| 3,204,368 | 9/1965 | Effinger, Jr. et al. | 244/154 |
| 3,276,730 | 10/1966 | Cleveland | 244/153 R |
| 3,305,198 | 2/1967 | Sellers, Jr. | 244/153 R |
| 3,949,519 | 4/1976 | Meyer | 46/79 |
| 3,954,235 | 5/1976 | Powell | 244/153 R |

FOREIGN PATENT DOCUMENTS

| | | | |
|---|---|---|---|
| 415069 | 9/1910 | France | 244/153 R |
| 344275 | 3/1931 | United Kingdom | 244/154 |
| 1055428 | 1/1967 | United Kingdom | 244/DIG. 1 |

*Primary Examiner*—Galen L. Barefoot
*Attorney, Agent, or Firm*—Cumpston & Shaw

[57] ABSTRACT

A toy glider kite capable of effectively functioning as a kite when held by a tow line and as a glider when released for free flying. The glider kite comprises a pair of flexible wing sections which are pivotal relative to one another between kite and normal glider modes of operation. In the kite mode of operation, the wing sections pivot to form a dihedral angle of one value in relation to a reference plane. In the normal glider mode of operation, the wing sections pivot to form a dihedral angle in relation to the reference plane which is smaller than the one value.

7 Claims, 11 Drawing Figures

GLIDER KITE

BACKGROUND OF THE INVENTION

1. Field of the Invention

This invention relates generally to aircraft, and more specifically to a toy glider kite.

2. Description of the Prior Art

Toy tow line launched gliders are generally known in the art of which most use a line-ring hook combination to effect release of the glider once it is airborne. Although this type of release mechanism is capable of releasing a glider, it suffers from certain undesirable disadvantages. One disadvantage is the tendency of the ring to release prematurely or not at all. Another disadvantage of such prior launched gliders is that they either function well as a stable kite but do not function well as a glider due to poor glide characteristics, or function well as a glider but do not function well as a kite. Such a kite is difficult for children to launch since the launching conditions such as wind speed, running speed, etc., are critical.

It is further known in the art to provide a glider kite having one portion of the aircraft functioning mainly as a kite and a separate portion of the aircraft functioning mainly as a glider. An aircraft of this type is disclosed in U.S. Pat. No. 3,153,877. This aircraft has the disadvantages that the kite and glider portions of the aircraft tend to function at cross purposes thereby making launching difficult and the gliding characteristics less desirable.

SUMMARY OF THE INVENTION

In accordance with a preferred embodiment of the invention, a glider kite is disclosed which is capable of functioning as a kite when held by a tow line and as a glider when released for free flying. The glider kite comprises a pair of flexible wing sections which are pivotally movable relative to one another in response to air flow past the wing sections between kite and normal glider modes of operation. Resilient support means are provided for supporting and holding the wing sections in the normal glider mode of operation. When the glider kite is held by a tow line, the air flow past the wing sections pivotally moves the wing sections into a kite mode of operation in which the wing sections form a dihedral angle of one value in relation to a reference plane. When the tow line is released, the resilient support means pivotally move the wing sections to the glider mode of operation in which the dihedral angle in relation to the reference plane is smaller than the one value. Accordingly, one of the advantages of Applicant's glider kite is that the entire glider kite when held by a tow line and subjected to air flow past the wing sections functions solely as a kite, and when the tow line is released the glider kite is free flying and automatically functions solely as a glider.

In a more specific aspect of the invention, the resilient supporting means for the wing sections comprises a living hinge nose connection between the wing sections to allow relative pivotal movment of the wing sections, and a resilient cross bar for each wing section for holding the wing sections in the normal glider mode of operation. Each cross bar is connected to its respective wing section by a lost motion connection to allow relative movement between the wing sections and cross bar while moving between the kite and glider modes of operation.

In a more specific aspect of the invention, the glider kite comprises a main central spar and a pair of side spars, one on each side of the main spar, with the leading ends thereof all mutually converging and joined together by a living hinge connection forming the nose of the kite. The wing sections are formed by flexible V-shaped wing sheet material spanning the space between the main spar and each of the side spars.

In a more specific aspect of this invention, the main spar has a leading portion connected to the living hinge and a trailing rudder portion at a slightly upward reflex angle to the leading portion. Also, adjustable means are provided on each of the side spars coacting with a complementary cross spar for adjusting the position of the cross spar on the side spar.

In another aspect of the invention, the glider kite has a tow line reel rotatably mounted on the main spar. A power means on the kite is coupled to the reel for winding the tow line onto the reel when the tow line is released. The power means comprises a Negator (trademark) spring motor.

The invention and these and other advantages will become more apparent from the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
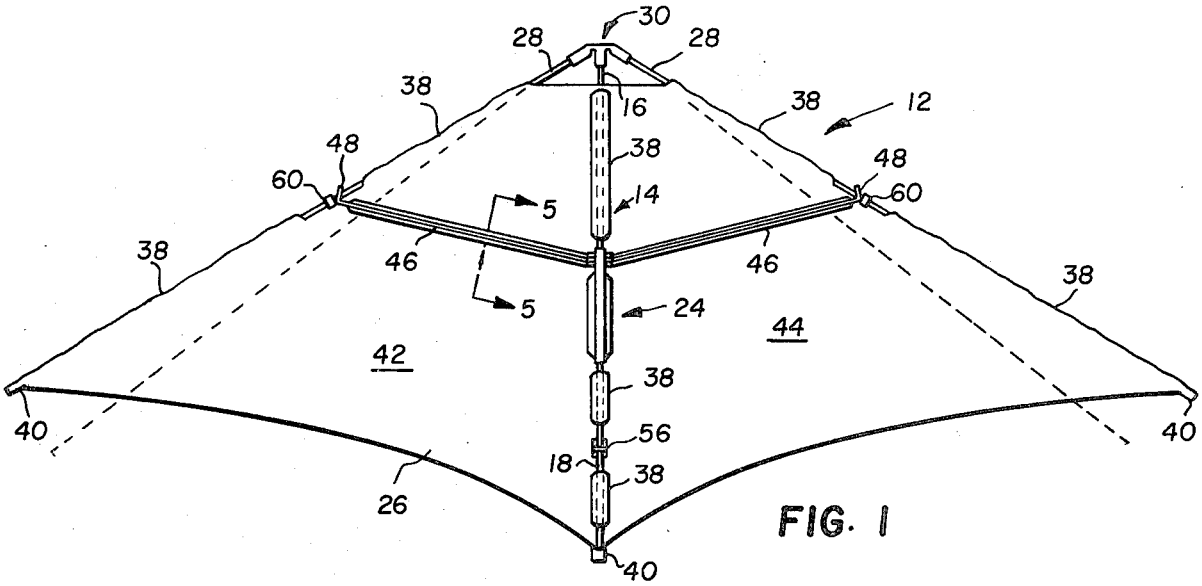
FIG. 1 is a bottom view of the glider kite of this invention showing the glider kite in its normal glider mode of operation in full lines, and a kite position in dotted lines.
Figure 2:
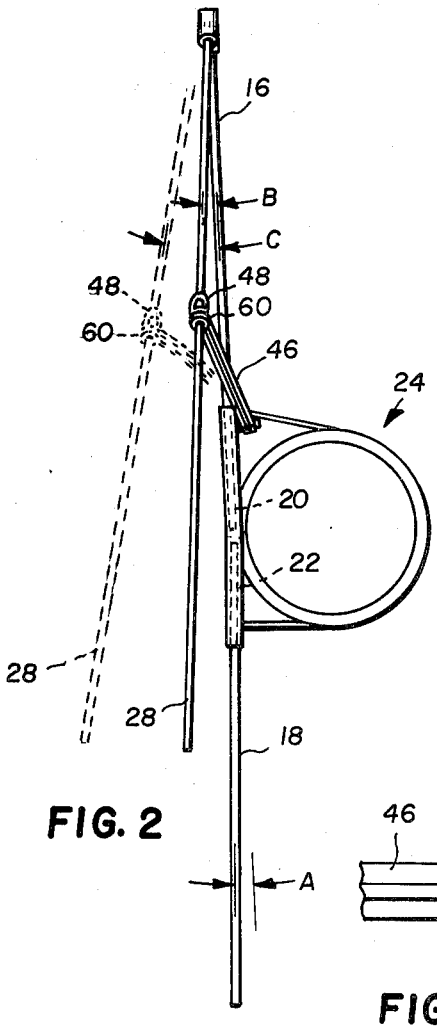
FIG. 2 is an enlarged side elevational view of the glider kite of FIG. 1 with the wing section sheet material removed for purposes of clarity.

With reference to FIGS. 1 and 2 of the drawings, a preferred embodiment of a glider kite 12 of this invention is disclosed comprising a main central spar 14 of any suitable cross-section such as cylindrical having a leading portion 16 and a trailing rudder portion 18. One end of each of the main spar portions 16, 18 is insertable into a blind bore 20, 22 respectively (FIGS. 2 and 9) at the upper end of an under-carriage 24 containing a tow line reel and motor mechanism to be explained hereinafter. The rudder portion 18 is inclined or upswept at a slight angle such as 10° relative to leading portion 16 to add a reflex to the kite sail or sheet material 26. The reflex facilitates recovery of kite 12 from a dive or descent, and flying of the kite in a horizontal orientation.

Figure 3:
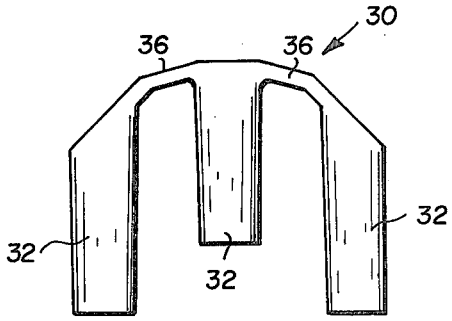
FIG. 3 is an enlarged top view of the living hinge kite nose.
Figure 4:
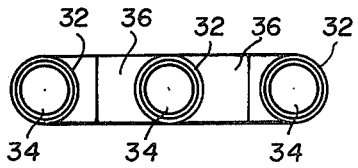
FIG. 4 is a bottom end view of the nose of FIG. 3.

The glider kite 12 further comprises a pair of side spars 28, one on each side of main spar 14, all of which mutually converge toward a point where they are joined together by a living hinge nose connection 30. The living hinge nose connection 30 is best seen in FIGS. 3 and 4 as cylindrical receptors 32 provided with blind bores 34 for receiving the leading ends of the main and cross spars 16, 28 inserted therein by a friction fit. The receptors 32 are joined together by integral flexible resilient flaps which form living hinges 36 for allowing pivotal and angular movement of side spars 28 relative to main spar 14.

The side spars 28 and leading and rudder portions 16, 18 of main spar 14 are slipped through hemmed sleeves 38 in a substantially V-shaped flexible sail or sheet material 26 of any suitable fabric with the trailing ends of side spars 28 and rudder portion 18 nesting into pockets 40 formed in the sheet material. The sail or sheet material 26 spanning the main and side spars forms two adjacent symmetrical wing sections 42, 44.

Figure 5:
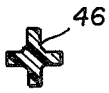
FIG. 5 is a cross sectional view taken substantially along line 5—5 of FIG. 1.
Figure 7:
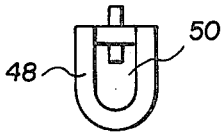
FIG. 7 is an end view of the cross spar of FIG. 6 with the side spar omitted for purposes of clarity.
Figure 6:
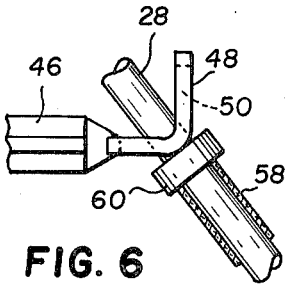
FIG. 6 is an enlarged segmental view of a portion of the glider kite of FIG. 1.
Figure 8:
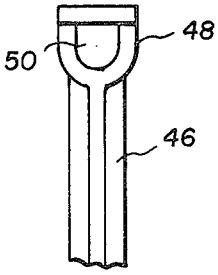
FIG. 8 is a top view of the cross spar of FIG. 6.

The glider kite 12 further has a pair of cross spars 46, each having an L-shaped bracket 48 (FIGS. 6–8) at one end provided with an enlarged opening 50 through which a complementary side spar 28 loosely extends. Openings 50 form a lost motion connection for allowing relative movement between brackets 48 and side spars 28. The opposite end of each cross spar has a cross-shaped section (FIG. 5) which is insertable only one way into a blind bore 52 (FIG. 9) of similar shape in under-carriage 24 for assembling the glider kite. In the assembled position, the flexible resilient cross spars 46 hold the glider kite 12 in its normal glider position or mode of operation as seen in full lines in FIGS. 1 and 2. In this normal glider position, the wing sheet material 26 spanning the main and side spars 14, 28 respectively is tightened slightly, but has some sag in it to facilitate kite launching. The side spars 28 and wing sections 42, 44 are pivoted relative to a plane passing through leading portion 16 of main spar 14 such that each wing section forms an upsweep or dihedral angle B as best seen in FIG. 2. The angle B is kept to a minimum in order to maintain stable flight with a good glide ratio.

If the glider kite 12 is held by a tow line 54 for kiting, air flow due to wind or the like passing by wing sections 42, 44 of the kite causes the side spars 28 and wing sections to pivot generally upwardly against the bias of resilient cross spars 46 into a kite position or mode of operation as depicted by dotted lines in FIGS. 1 and 2. In this kite mode of operation, each of the side spars 28 and wing sections 42, 44 is pivoted through a larger dihedral angle C as best seen in FIG. 2. In this kite position, the wing sheet material 26 not only sags slightly, but billows or arches upwardly forming a large center keel between the main and side spars to allow air to spill out and to stabilize the glider kite in its kiting mode of operation. The side spars 28 automatically adjust their positions and dihedral angle C to maintain the optimum combination of lift and stability while kiting.

When tow line 54 is released so that glider kite 21 is free flying, the air flow pressure on wing sections 42, 44 decreases and the resilient cross spars 46 automatically return the wing sections back to the gliding position or mode of operation in which the kite can glide gracefully to the ground. A slidably adjustable weight 56 (FIG. 1) on rudder portion 18 and a tape sleeve 58 (FIG. 6) on each side spar 28 (for adjusting the position of a slidable stop member 60 and cross spar bracket 48 in engagement therewith) facilitates optimum trimming of the glider kite in its gliding mode of operation. For example, if the glider kite should glide with a dipping or porpoising motion, weight 56 should be moved slightly toward nose 30. If the kite glides nose down, weight 56 should be slid toward the rear. If the kite glides in a circle or kites toward one side, stop menber 60 should be moved rearwardly slightly on the leading side spar 28 toward which it flies, or stop member 60 moved forwardly on the opposite side spar.

Figures 9, 10, 11:
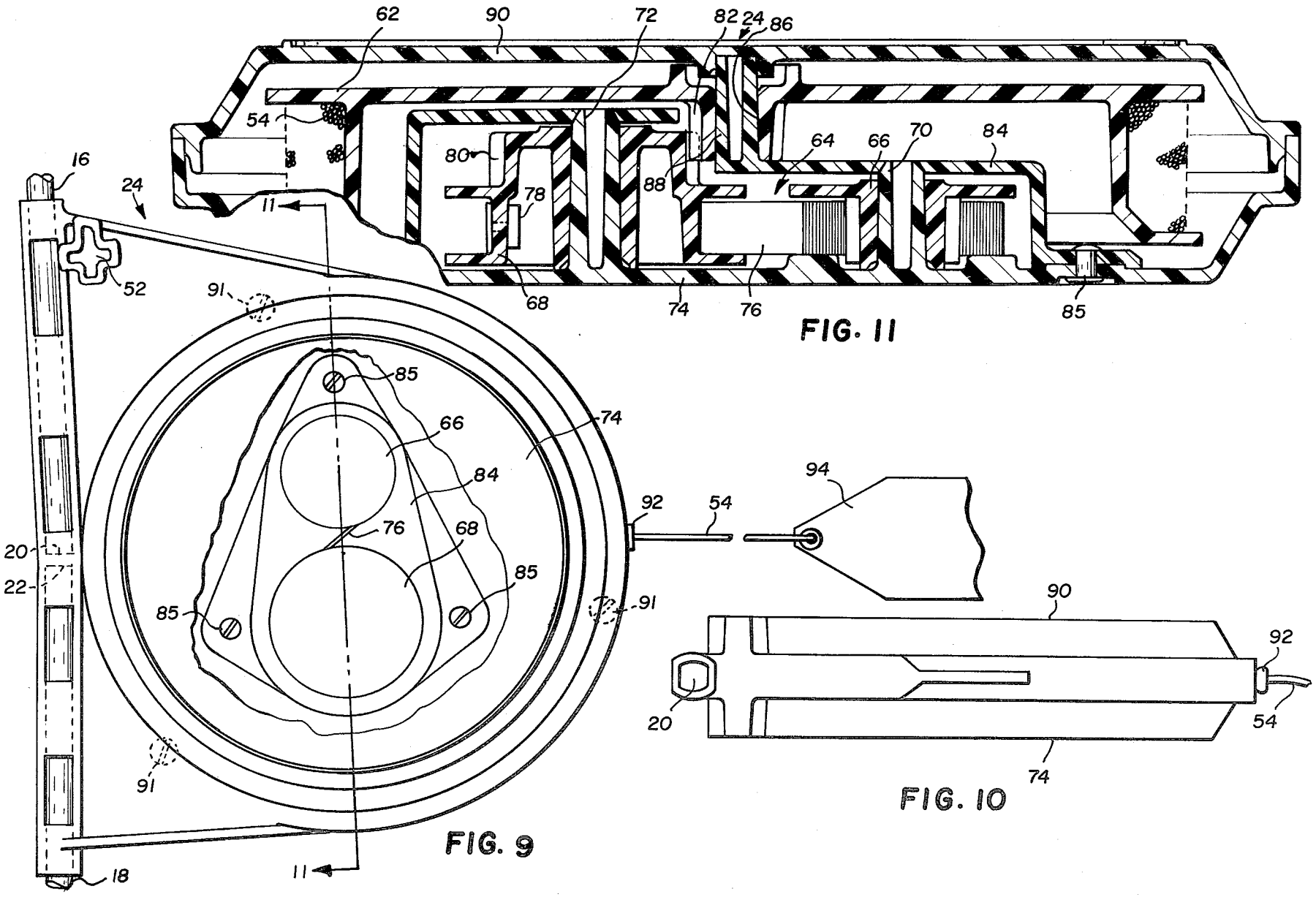
FIG. 9 is a side elevational view of the undercarriage supporting the tow line reel and motor means.
FIG. 10 is an end elevational view of the undercarriage of FIG. 9.
FIG. 11 is a section view taken substantially along line 11—11 of FIG. 9.

The tow line reel and motor mechanism supported by under-carriage 24 for paying out line 54 and rewinding the line when released is best illustrated in FIGS. 9–11. The mechanism comprises a tow line reel 62, a power means such as a Negator (trademark) spring motor 64, and gear means 80, 82 coupling the two together. The motor 64 comprises a pair of drums 66, 68 mounted on posts 70, 72 respectively extending laterally from a cup-shaped mounting wall 74 of under-carriage 24. A leaf-type spring 76 has one end attached to drum 66, its intermediate portion wound therearound and its opposite end secured to drum 68 at 78. Drum 68 has an outer gear 80 integral therewith in meshing engagement with a pinion gear 82 on tow line reel 62. The gear diameters are properly selected to effect a maximum number of reel rotations for maximum line storage. The motor 64 is enclosed within a housing 84 secured to mounting wall 74 by screws 85, the housing having a cutout portion through which gears 80, 82 mate. The reel 62 has a central opening 86 through gear 82 for receiving a laterally extending post 88 on housing 84 which rotatably supports the reel and further serves to position gears 80, 82 in proper meshing engagement. The reel 62 and motor 64 is enclosed by a cover plate 90 secured to mounting wall 74 by any suitable means such as screws 91. The wall 74 has a slot, not shown, for receiving a sleeve 92 through which tow line 54 passes and to which a kite tail 94 in the form of a flat strip is attached. The sleeve 92 serves as a bearing or wear surface and further cleans the line of foreign particles which might affect motor operation. The tail 94 provides a pleasing grasp point for a child and serves to provide additional eye-pleasing action to the glider kite when retracting and when gliding.

Although a spring motor 64 is disclosed for rewinding the line, it should be understood that it could be replaced by any other potential energy system such as a standard clockwork type spring or an elastic member such as a rubber band. It could also be replaced by an external powered system such as an electric motor and battery, or a propellor or similar wind gathering device.

The invention has been described in detail with particular reference to a preferred embodiment, but it will be understood that variations and modifications can be effected within the spirit and scope of the invention as described.

What is claimed is:

1. A toy glider kite capable of functioning as a kite when held by a tow line and as a glider when released for free flying comprising:

a main center spar;

a pair of side spars, one on each side of said main spar with the leading ends of said main and side spars mutually converging;

a living hinge for connecting the converging leading ends of said main and side spars together to form a nose of the kite, said living hinge allowing pivotal movement of said side spars;

flexible V-shaped wing material spanning the space between said main spar and each of said side spars and connected thereto to form a pair of flexible substantially symmetrical wing sections; and a pair of resilient cross spars in which one end of each of said cross spars is connected to the main spar and the opposite end of each of said cross spars has an opening extending therethrough through which a corresponding one of said side spars loosely extends for supporting said wing sections for pivotal movement relative to one another between kite and normal glider positions;

said wing sections being responsive to air flow past the wing sections when held by an extended tow line for movement from said normal glider position to said kite position in which said wing sections pivot to form a dihedral angle of one value in relation to a reference plane;

said wing sections further being responsive to air flow past the wing sections when the tow line and kite are released for free flying for automatic return movement of said wing sections in response to said resilient cross spars to said normal gliding position in which said wing sections pivot to form a dihedral angle in relation to said reference plane which is smaller than said one value.

2. The glider kite of claim 1, and further comprising adjustable means on each of said side spars coacting with said opposite end of said complementary cross spar for adjusting the position of said opposite end of said cross spar on said side spar.

3. The glider kite of claim 1 wherein said main spar has a leading portion connected to said living hinge, and a trailing rudder portion at a slight upward reflex angle to said leading portion.

4. The glider kite of claim 1, and further comprising a reel rotatably mounted on said main spar, said reel having the tow line attached thereto and wound thereon; power means on the kite; and means coupling said power means to said reel for winding the tow line onto said reel when the tow line is released.

5. The glider kite of claim 4 wherein a tail in the form of a flat strip is attached to the free end of the tow line.

6. The glider kite of claim 4 wherein said power means comprises spring means.

7. The glider kite of claim 6 wherein said spring means comprises first and second drums, a spring having one end connected to said first drum and wound thereon in a substantially untensioned state with the opposite end of said spring connected to said second drum, a drive gear on said second drum, and a driven gear on said reel in meshing engagement with said drive gear whereby when said tow line is unreeled said reel and driven gear rotatably drives said second drum to wind up said spring on said second drum to its tensioned state, and when said tow line is released said tensioned spring returns to its substantially untensioned state on said first drum and during such movement rotates said reel through said drive and driven gears for winding up the tow line.

* * * * *